United States Patent [19]

Shaw

[11] Patent Number: 4,974,281

[45] Date of Patent: Dec. 4, 1990

[54] MULTI-PURPOSE WALL WRINGER

[76] Inventor: Grace E. Shaw, 133 Catherine St., East Peoria, Ill. 61611

[21] Appl. No.: 491,258

[22] Filed: Mar. 9, 1990

[51] Int. Cl.[5] ..... A47L 13/14; A47L 13/58

[52] U.S. Cl. ..... 15/261; 15/260

[58] Field of Search ..... 15/260, 261; 100/116, 100/125, 126; 68/241, 235 D

[56] References Cited

U.S. PATENT DOCUMENTS

| | | | |
|---|---|---|---|
| 336,956 | 3/1886 | Smith | 100/116 |
| 837,924 | 12/1906 | Guitar | 68/241 |
| 942,001 | 11/1909 | Lovett | 68/241 |
| 942,135 | 12/1909 | Davis | 15/261 |
| 944,728 | 12/1909 | Flynn | 15/261 |
| 1,009,308 | 11/1911 | Hilker | 15/261 |
| 2,166,965 | 7/1939 | Palmer | 15/261 |
| 2,803,832 | 8/1957 | schif | 68/241 |
| 4,047,261 | 9/1977 | Rones | 15/261 |

FOREIGN PATENT DOCUMENTS

| | | | |
|---|---|---|---|
| 3316499 | 11/1984 | Fed. Rep. of Germany | 68/241 |
| 0570590 | 12/1957 | Italy | 15/261 |
| 0080176 | 7/1919 | Switzerland | 100/125 |

*Primary Examiner*—Paul T. Sewell
*Assistant Examiner*—Ted Kavanaugh
*Attorney, Agent, or Firm*—Douglas B. White

[57] ABSTRACT

The present invention provides a wall mounted apparatus for wringing a mop comprising a base member adapted to be mounted to a wall; a door member hingedly affixed to the base for pivotal movement; and a panel member mounted to the inside surface of the door and forming a receptacle there between to accept a wet mop. The panel is mounted to move between a first position away from the door and a second position against the door, whereby closure of the door against the base causes the panel to be forced toward the door to squeeze the mop.

9 Claims, 3 Drawing Sheets

MULTI-PURPOSE WALL WRINGER

BACKGROUND OF THE INVENTION

1. Field of the Invention

This invention relates generally to apparatus for wringing mops or the like. More particularly this invention relates to wall mounted apparatus for wringing mops and especially dust mops.

2. Description of the Prior Art

Generally the prior art provides devices for wringing wet floor mops over buckets containing a wash/rinse solution. These devices generally provide pivoting plates which are operated by handle levers. Typical of this construction are U.S. Pat. Nos. 942,135, 2,516,753, and 2,522,891. These devices are known to squirt water at the operators and furthermore they require operation in an uncomfortable bent-over posture which limits the strength the operator can apply.

SUMMARY OF THE INVENTION

It is therefore a principal objective of the present invention to provide an apparatus for wringing mops, and especially dust mops, which is mountable on a wall to allow easier and more convenient operation and which better controls the flow of water squeezed from the mop.

The present invention provides a wall mounted apparatus for wringing a mop comprising a base member adapted to be mounted to a wall; a door member hingedly affixed to the base for pivotal movement; and a panel member mounted to the inside surface of the door, forming a gap there between to accept a wet mop. That the panel is mounted such that it is allowed to move between a first position away from the door and a second position against the door. Closure of the door against the base causes the panel to be forced by the base member toward the door member to squeeze the mop.

While the invention will be described in connection with a preferred embodiment, it will be understood that I do not intend to limit the invention to that embodiment. On the contrary, I intend to cover all alternatives, modifications, and equivalents as may be included within the spirit and scope of the invention as defined by the appended claims.

DESCRIPTION OF THE PREFERRED EMBODIMENT

Figure 1:
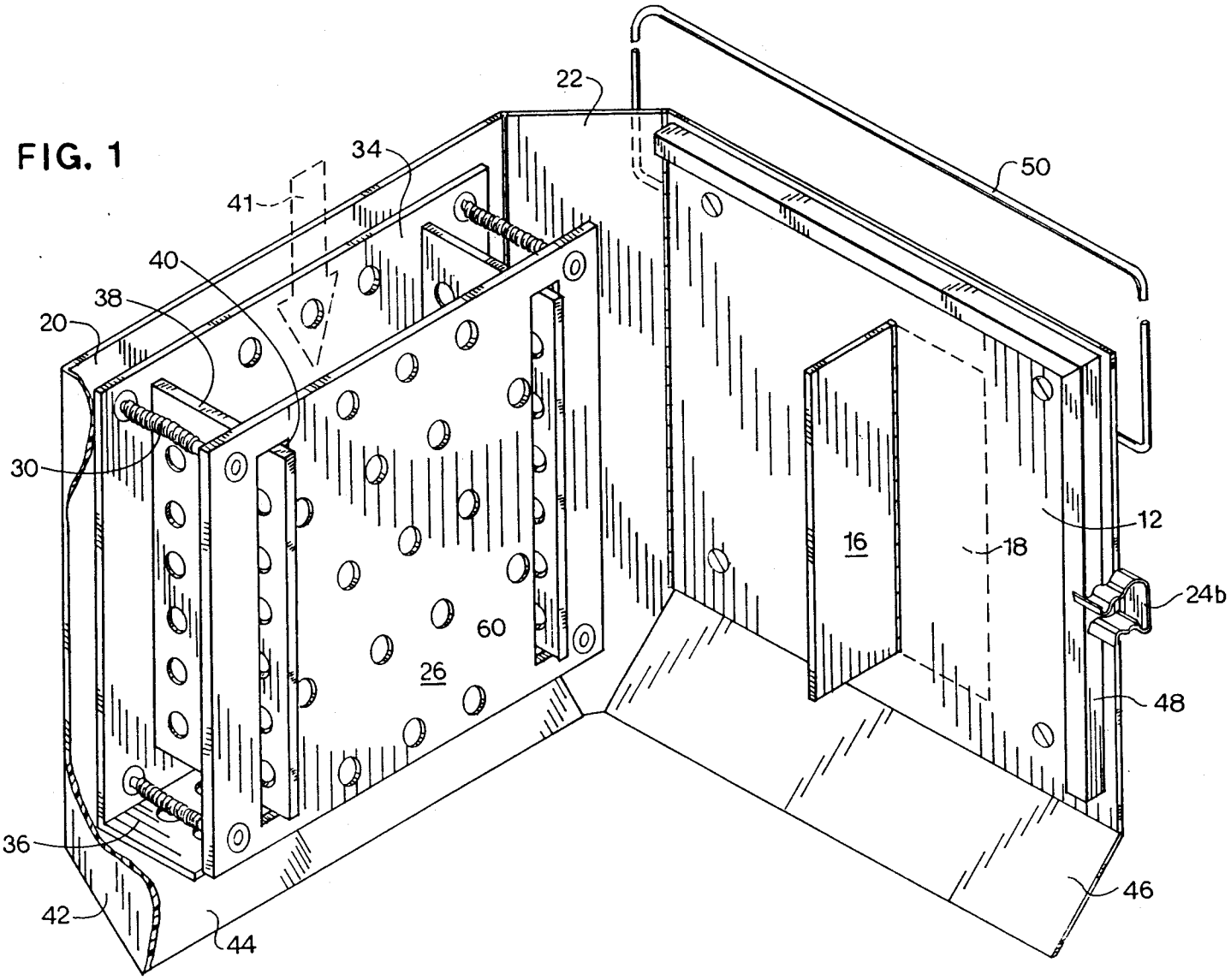
FIG. 1 is a perspective view of the apparatus of the present invention in an open position.

Turning first to FIG. 1 there is shown a mop squeezing apparatus in accordance with the present invention. A wall mounted base member 12 is arranged to be affixed to the wall by attachment means. (The attachment may be any technique known in the art.) Projecting outwardly from this base is an actuator plate 16 arranged to hinge to a non-actuating position 18 when the apparatus is not in use.

A door member 20 is mounted to the base by a hinge 22 and arranged to be closed and secured by latch means **24*a* and 24*b*. A pressure panel 26 is positioned for reciprocal motion on mounting shafts 30 and urged toward the shaft extremity by springs mounted thereon. A back plate 34 having a lower rest plate 36 is rigidly fixed to the shafts 30 to provide a separation from the dood member. Side plates 38 are fixed to the back plate and project through slots 40 in the pressure plate to trap the mop 41 there between. Side deflector 42 and bottom deflectors 44 and 46 control water flow from the side and bottom. Strip 48** provides deflection along the base member to further control the flow of the water.

Figure 3:
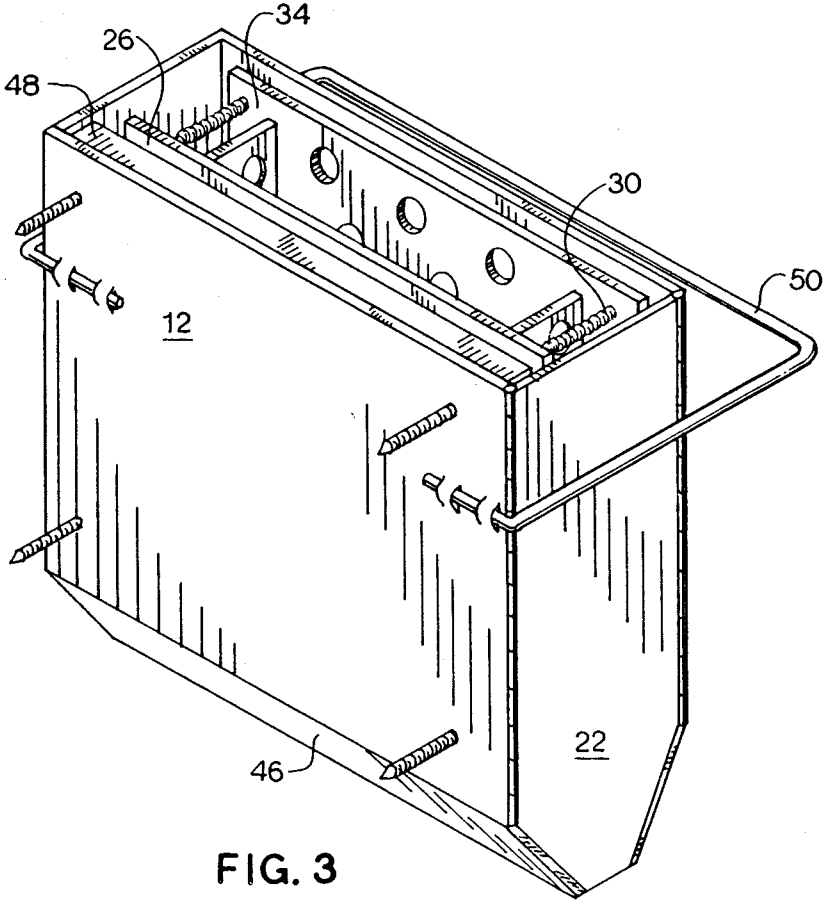
FIG. 3 is a perspective view of the apparatus of FIG. 1 in a closed storage position as viewed from the back.
Figure 2:
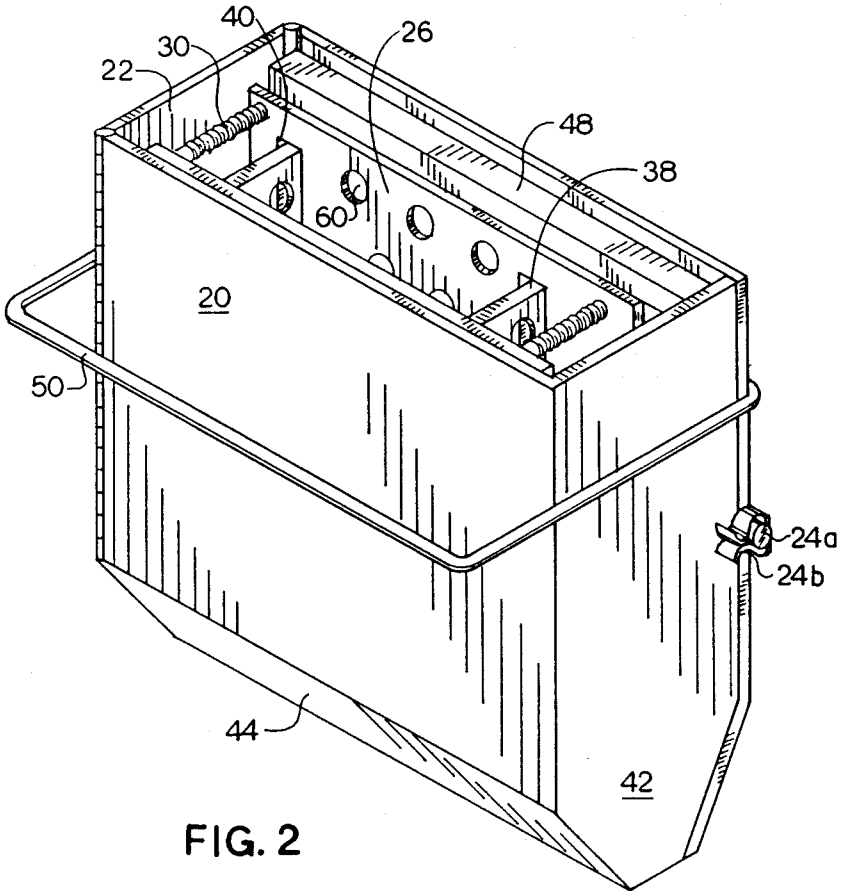
FIG. 2 is a perspective view of the apparatus of FIG. 1 in a closed storage position as viewed from the front.
Figure 6:
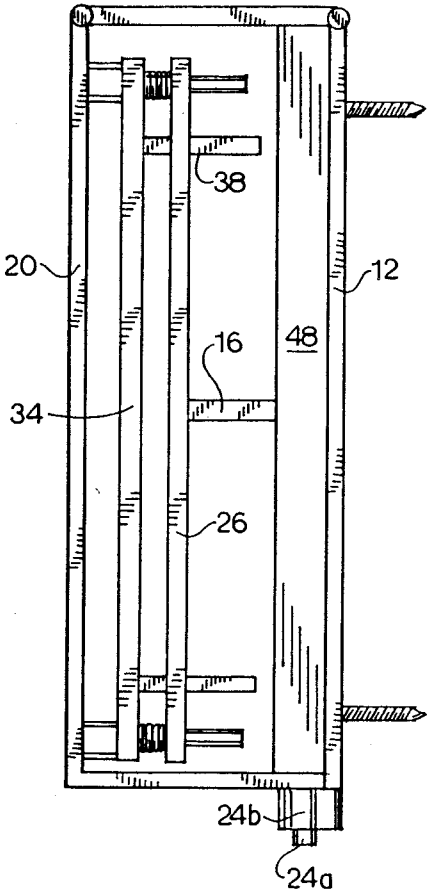
FIG. 6 is a top view of the apparatus of FIG. 1 in a closed position.
Figure 5:
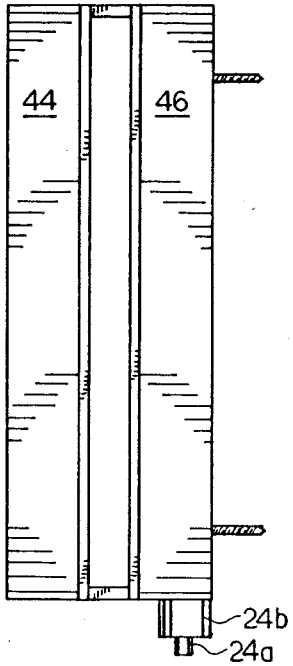
FIG. 5 is a bottom view of the apparatus of FIG. 4.
Figure 4:
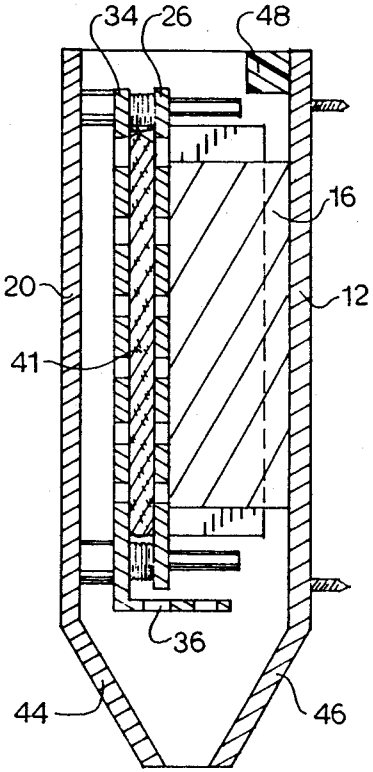
FIG. 4 is a side sectional view of the apparatus of FIG. 2 in a closed position.

As shown in FIGS. 4–6, closure of the door causes contact of the pressure panel 26 against the actuator plate 16 and forces the panel toward the backplate. A mop 41 placed between the pressure panel, back plate and side plates is squeezed there between. Water exiting the mop flows through holes 60 in the plates to contact the side and bottom deflectors where it is directed to a drain situated underneath the apparatus. Once a mop has been squeezed and removed from the wringer, the actuator plate 16 is pivoted out of the way and the hanger bar 50 is rotated to a frontal position (FIGS. 2 and 3). In this storage position the mop may be draped on the hanger bar to dry.

From the foregoing description, it will be apparent that modifications can be made to the apparatus and method for using same without departing from the teachings of the present invention. Accordingly, the scope of the invention is only to be limited as necessitated by the accompanying claims.

I claim:

1. Wall mounted apparatus for wringing a wet mop comprising:

a base member adapted to be mounted to a wall;

a door member hingedly affixed to said base member for pivotal movement; and a panel member mounted to the inside surface of said door member and arranged to form a gap there between to accept a wet mop, said panel member being mounted for movement between a first position and a second position, whereby closure of said door member against said base member causes said panel member to be forced to move toward said door member.

2. The wall mounted apparatus for wringing a wet mop of claim 1 further comprising an actuating member mounted to said base member to contact said panel member and cause movement thereof when said door member is moved to said closed position.

3. The wall mounted apparatus for wringing a wet mop of claim 2 wherein said actuating member is mounted to be selectively movable to a non-actuating position.

4. The wall mounted apparatus for wringing a wet mop of claim 2 further comprising a perforated back plate mounted to said door member between said door member and said panel member such that a gap is maintained between said door member and said back plate, and a receptacle is defined between said back plate and said panel member to accept the wet mop.

5. The wall mounted apparatus for wringing a wet mop of claim 4 further comprising side plates mounted to said back plate and arranged to project through slots in said panel member.

6. The wall mounted apparatus for wringing a wet mop of claim 4 further comprising a rest plate projecting from said back plate.

7. The wall mounted apparatus for wringing a wet mop of claim 6 further comprising deflection means positioned proximate the periphery of said apparatus to redirect water emanating therefrom.

8. The wall mounted apparatus for wringing a wet mop of claim 7 further comprising latch means for holding said door member to said base member.

9. The wall mounted apparatus for wringing a wet mop of claim 8 further comprising a stiff bar member arranged to project in front of said door member for supporting mops therefrom.

* * * * *